United States Patent [19]

Yates et al.

[11] Patent Number: 4,710,248

[45] Date of Patent: Dec. 1, 1987

[54] EMULSION EXPLOSIVE COMPOSITION

[75] Inventors: David E. Yates; Stuart W. Dack, both of Melbourne, Australia

[73] Assignee: ICI Australia Limited, Victoria, Australia

[21] Appl. No.: 898,674

[22] Filed: Aug. 21, 1986

[30] Foreign Application Priority Data

Aug. 21, 1985 [AU] Australia ..... PH2061

[51] Int. Cl.[4] ..... C06G 45/00

[52] U.S. Cl. ..... 149/21; 149/2; 149/46; 149/61; 149/76; 149/83; 149/85; 149/105; 149/109.6

[58] Field of Search ..... 149/2, 21, 109.6, 46, 149/61, 76, 83, 85, 105

[56] References Cited

U.S. PATENT DOCUMENTS

| | | | |
|---|---|---|---|
| 4,386,977 | 6/1983 | Ikeda et al. | 149/2 |
| 4,473,418 | 9/1984 | Bampfield et al. | 149/2 |
| 4,490,194 | 12/1985 | Cooper et al. | 149/2 |
| 4,490,195 | 12/1985 | Cooper et al. | 149/2 |

FOREIGN PATENT DOCUMENTS

| | | |
|---|---|---|
| 0018085 | 10/1980 | European Pat. Off. . |
| 0152184 | 8/1985 | European Pat. Off. . |
| 0155800 | 9/1985 | European Pat. Off. . |
| 2138800 | 10/1984 | United Kingdom . |

OTHER PUBLICATIONS

European Search Report, EP 86 30 6029, Nov. 20, 1986.

*Primary Examiner*—Stephen J. Lechert, Jr.
*Attorney, Agent, or Firm*—Cushman, Darby & Cushman

[57] ABSTRACT

An emulsion explosive comprising substantially an immiscible discontinuous oxidizer-phase dispersed throughout a continuous fuel phase with a modifier comprising hydrophilic and lipophilic moieties wherein the hydrophilic moiety comprises a carboxylic acid group or a group capable of hydrolyzing to a carboxylic acid, the lipophilic moiety is a saturated or unsaturated hydrocarbon chain, and wherein the emulsion composition pH is above 4.5.

23 Claims, No Drawings

EMULSION EXPLOSIVE COMPOSITION

This invention relates to an explosive composition and in particular to explosive compositions comprising a discontinuous oxidizer phase dispersed throughout a continuous fuel phase which is substantially immiscible with the discontinuous phase.

Commercially available emulsion explosives are commonly of the water-in-oil type wherein discrete droplets of an aqueous solution of an oxygen-supplying source are dispersed as a discontinuous phase within a continuous organic fuel phase. Such water-in-oil emulsion explosive compositions have been described in U.S. Pat. Nos. 3,447,978, 3,674,578, 3,770,522, 4,104,092, 4,111,727, 4,149,916 and 4,149,917.

In some applications the water content in the oxidizer phase may be reduced to very low levels, for example less than 4%, or even completely eliminated. Such melt-in-oil emulsion explosives have been described in U.S. Pat. No. 4,248,644. Throughout this specification the term "emulsion explosive composition" embraces both water-in-oil or melt-in-oil types.

In these emulsion explosive compositions surface tension modifying emulsifiers are used to promote subdivision of the droplets of oxidizer phase and subsequent dispersion in the continuous phase. The emulsifiers also have a stabilizing effect on the emulsion preventing breakdown by inhibiting coalescence and agglomeration of the droplets. In addition, the droplets of oxidizer phase are inherently metastable and exhibit a tendency to crystallize. Crystal growth impairs the sensitivity to detonation of the emulsion explosive compositions and in severe cases the interlocking of crystals produces a solid composition which is very difficult to prime. Thus conventional emulsion explosive compositions are prone to a progressive deterioration of explosive performance both during storage and transportation of the explosives prior to use.

A variety of emulsifier types and blends of emulsifiers have been tried in attempts to reduce the deterioration of explosive performance on storage. Some of these emulsifiers are designed to provide significant suppression of coalescence of the oxidizer droplets while others function as crystal habit modifiers to control and limit crystal formation and growth within the aqueous oxidizer phase. While some of these emulsifiers have been successful in improving the stability of the emulsion explosive compositions they have reduced the sensitivity of the compositions to detonation and have increased the minimum acceptable diameter of cartridges filled with the compositions for satisfactory detonation. If the acceptable diameter is reduced by including eutectic forming salts, such as calcium nitrate, in the compositions, less gas is generated on detonation leading to a lower explosive performance.

It is an object of our invention to provide emulsion explosive compositions which suffer minimal deterioration on storage.

Accordingly we provide an emulsion explosive composition comprising a discontinuous oxidizer-phase comprising an oxygen-supplying component and an organic-fuel medium forming a continuous phase wherein the oxygen-supplying component and organic-fuel medium are emulsified in the presence of a modifier comprising a hydrophilic moiety and a lipophilic moiety wherein the hydrophilic moiety comprises a carboxylic acid or a group capable of hydrolyzing to a carboxylic acid and wherein the lipophilic moiety is a saturated or unsaturated hydrocarbon chain, and wherein the said emulsion explosive composition pH, as hereinafter defined, is above 4.5.

The groups capable of hydrolyzing to a carboxylic acid group referred to hereinbefore include, for example, esters and carboxylic anhydrides. In general, it is preferred that the average molecular weight of the said modifier is in the range 250 to 5000 and more preferably 400 to 5000.

The lipophilic chain structure will preferably incorporate a backbone sequence of at least 10, and preferably not more than 500, linked atoms. These atoms may all be carbon atoms or they may be predominantly carbon atoms containing hetero atoms such as nitrogen and oxygen. A preferred lipophilic moiety is a saturated or unsaturated hydrocarbon chain derived, for example, from a polymer of a mono-olefin, the polymer chain containing from 20 to 500 carbon atoms. Suitable polyolefins include those derived from olefins containing from 2 to 6 carbon atoms. The preferred olefins include propylene, butene-1, ethylene isoprene, and in particular, isobutene.

A particularly preferred modifier is [poly[alk(en)y]-succinic acid and derivatives thereof such as poly[alk-(en)yl]succinic anhydride. The preferred members of this group have average molecular weights in the range 400 to 5000.

Another useful modifier is that derived from a polymer obtained by the interesterification of one or more saturated or unsaturated $C_{10}$ to $C_{25}$ monohydroxy monocarboxylic acids, optionally in admixture with a minor proportion of one or more non-hydroxylic monocarboxylic acids. The commercially available mixture of 12-hydroxystearic acid and stearic acid may, for example, be usefully employed with or without admixture of further material to yield by interesterification a suitable complex monocarboxylic acid. The molecular weight of the resulting complex acid may vary from 500 to 5000.

Interesterification of the monohydroxy and non-hydroxylic monocarboxylic acids may be affected by known techniques, for example by heating the reactants in a hydrocarbon solvent, such as xylene, in the presence of a catalyst such as tetrabutyltitanate.

The compositions of the invention may comprise a single modifier, although a mixture of two or more modifiers may be employed, if desired. The modifer or modifiers may be incorporated into the emulsification medium in conventional manner.

The amount of modifier required in the compositions of the invention is generally small. The required amount of modifier is readily assessed by simple experimental trial, and is generally observed to be within a range of from 0.1 to 5.0%, preferably from 0.1 to 4.0%, and most preferably from 0.5 to 2.5 by weight of the total explosive composition.

It is a critical feature of our invention that the emulsion explosive composition pH be maintained above 4.5 since the modifiers are ineffective at low pH. Preferably the emulsion composition pH is below 7–8. Hence the composition preferably has a pH in between 4.5 and 8 and more preferably between 4.5 and 7.

The phrase emulsion explosive composition pH, where used herein refers to the pH of the said oxidizer phase of the emulsion explosive composition.

We have found it most convenient to measure and adjust the pH of the oxidizer phase to the desired pH after the oxidizer phase has been prepared but before the emulsion is formed, such as is demonstrated in Example 1 of this specification. However if desired the pH of the oxidizer phase may be determined and/or altered after formation of the emulsion.

The pH control may readily be achieved by the addition of a suitable buffer, such as, for example, sodium acetate, sodium dihydrogen phosphate, or disodium hydrogen phosphate. If modifiers with precursors to carboxylic acids are employed the addition of an appropriate amount of a base such as for example sodium carbonate, sodium phosphate or sodium hydroxide at the stage of forming the emulsion will both hydrolyze the precursor modifier to the desired modifier and form a buffered system at a suitable pH. Other bases that may be used include organic bases such as methylamine, ethanolamine or ethylene diamine.

Generally it will be preferred in the modifier component of the present invention, that any modifier comprising a group capable of hydrolyzing to a carboxylic acid has been hydrolyzed.

Hence there is provided an emulsion explosive comprising: discontinuous phase comprising an oxygen-supplying component; a continuous phase comprising an organic fuel medium; and a modifier comprising a hydrophilic moiety and a lipophilic moiety wherein the hydrophilic moiety comprises a carboxylic acid group.

It will be understood that under the emulsion conditions the carboxylic acid may be present in the ionized from as a salt. Hence where we use the term carboxylic acid the term will be understood to include salts of carboxylic acids.

Generally the nature of the counter ion of such a salt is not narrowly critical as it will be understood by those skilled in the art that the modifier of the present composition may be in the form of a salt which may have a wide range of counter ions.

Typical counter ions may for example be cations of alkali and alkaline earth metals (such as sodium potassium and calcium) or cations of organic bases selected from the group of ammonia; mono- di- and tri-($C_1$ to $C_6$ alkyl) amines; and $C_1$ to $C_6$ alkanolamines.

Emulsifiers hitherto employed in the production of emulsion explosive compositions have generally exhibited a hydrophilic-lipophilic balance (HLB) of less than about 10. Such conventional emulsifiers may if desired be included together with one or more modifiers of our invention in formulating the emulsion explosive compositions of the present invention. However, successful formulation and storage stability is readily achieved in the absence of a conventional emulsifier.

Many suitable conventional emulsifiers have been described in detail in the literature and include, for example, sorbitan esters, such as sorbitan sesqui-oleate, sorbitan mono-oleate, sorbitan mono-almitate, sorbitan mono-stearate and sorbitan tristearate, the mono- and diglycerides of fat-forming fatty acids, soyabean lecithin and derivatives of lanolin, such as isopropyl esters of lanolin fatty acids, mixtures of higher molecular weight fatty alcohols and wax esters, ethoxylated fatty ethers, such as polyoxyethylene (4) lauryl ether, polyoxyethylene (2) oleyl ether, polyoxyethylene (2) stearyl ether, polyoxyalkylene oleyl laurate, and substituted oxazolines, such as 2-oleyl-4,4'-bis-(hydroxymethyl)-2-oxazoline. Suitable mixtures of such conventional emulsifiers may also be selected for use, together with one or more modifiers, in the compositions of the present invention.

Where it is desired to use a conventional emulsifier the preferred amount of emulsifier is readily determined by simple experimentation, but generally the combined amount of modifier(s) and conventional emulsifier(s) will not exceed about 5% by weight of the total explosive composition. Higher proportions of emulsifier and/or modifier may be tolerated, excess amounts serving as a supplemental fuel for the composition.

The oxygen-supplying component of the discontinuous oxidizer phase suitably comprises any oxidizer salt capable of releasing oxygen in an explosive environment in an amount and at a rate sufficient to confer acceptable explosive characteristics on the emulsion composition. Inorganic oxidizer salts conventionally employed in the production of emulsion explosive compositions, and suitable for inclusion in the compositions of the present invention include ammonium salts and salts of the alkali- and alkaline-earth metals, such as the nitrate, chlorate and perchlorate salts, and mixtures thereof. Other suitable salts include hydrazine nitrate and urea perchlorate. The oxygen-supplying component may also comprise an acid, such as nitric acid.

Preferably the oxygen-supplying component is selected from the group consisting of ammonium nitrate, sodium nitrate, calcium nitrate and mixtures thereof.

Typically, the oxygen-supplying component of the composition of the present invention comprises from 40 to 95% and preferably from 60 to 90% by weight of the total composition.

Ammonium nitrate is preferably employed as a primary oxidizer salt comprising at least 50% by weight of the oxygen-supplying salt component, supplemented, if desired, by a minor (not exceeding 50% by weight) amount of a secondary oxygen-supplying component, such as calcium nitrate or sodium nitrate. A secondary oxidizer component may be incorporated into an aqueous discontinuous phase but its presence is particularly desirable if the oxygen-supplying component is to be incorporated into the emulsion in the form of a melt, i.e., in the substantial or complete absence of water from the discontinuous phase. Suitable secondary oxidizer components which form an eutectic melt when heated together with ammonium nitrate include inorganic oxidizer salts of the kind hereinbefore described, such as the nitrates of lead, silver, sodium and calcium, and organic compounds, such as mono- and polyhydroxylic compounds including methanol, ethylene glycol, glycerol, mannitol, sorbitol and pentaerythritol, carbohydrates, such as glucose, sucrose, fructose and maltose, aliphatic carboxylic acids ahd their derivatives, such as formic acid and formamide, and organo-nitrogen compounds, such as urea, methylamine nitrate and hexamethylene tetramine, and mixtures thereof.

It is a particular advantage of the compositions of our invention that the oxygen-supplying component (for example, ammonium nitrate) need not be of the high purity required for the prior art explosives compositions employing conventional emulsifiers. In particular other grades of ammonium nitrate may conveniently be employed, such as for example, ammonium nitrate made by the "Topan" process, wherein the ammonium nitrate may contain nucleating agents such as aluminium, alum, or long chain surfactants and clays. Concentrations of nucleating agent in such commercial grades of ammonium nitrate may for example be in the range of 200 to 1000 ppm. Such additives are unacceptable in the ammonium nitrate used to prepare emulsion explosive compositions with the aid of conventional emulsifiers.

When conventional emulsifiers are used in preparation of emulsion explosives the presence of nucleating agents leads to crystallisation of the composition which results in poor explosive performance.

Consequently the present composition may comprise a commercial grade ammonium nitrate.

Examples of commercial grades of ammonium nitrate and examples of the "Topan" process are disclosed in Australian Patent Application No. 50,425/69 and Australian Patent Application No. 81,346/75.

If desired, the emulsion composition may additionally comprise a solid oxidizer component, such as solid ammonium nitrate or ammonium perchlorate, conveniently in the form of prills or powder, respectively.

Typically, the discontinuous oxidizers phase may comprise from about 20 to about 97%, more usually from 30 to 95%, and preferably from 70 to 95% by weight of the total emulsion explosive composition. The discontinuous phase may be entirely devoid of water, in the case of a melt emulsion, or may comprise relatively minor amounts of water, for example from 2 to 30%, more usually from 4 to 25% and preferably from 8 to 18% by weight of the total composition.

The organic-fuel medium capable of forming the continuous phase of an emulsion explosive composition in accordance with the invention serves as a fuel for the explosive composition and should be substantially insoluble in the component(s) of the discontinuous phase with which it should be capable of forming an emulsion in the presence of an effective amount of an appropriate emulsifying agent. Ease of emulsification depends, inter alia, on the viscosity of the organic medium, and although the resultant emulsion may have a substantially solid continuous phase, the organic medium should be capable of existing intially in a sufficiently fluid state, if necessary in response to appropriate temperature adjustment, to permit emulsification to proceed.

Suitable organic-fuel media which are capable of existing in the liquid state at convenient emulsion formulation temperatures include saturated and unsaturated aliphatic and aromatic hydrocarbons, and mixtures thereof. Preferred media include refined (white) mineral oil, diesel oil, paraffin oil, petroleum distillates, benzene, toluene, dinitrotoluene, styrene, xylenes, and mixtures thereof.

In addition to the organic-fuel medium the continuous phase may optionally comprise a wax to control the rheology of the system, although the presence of a wax is not essential. Suitable waxes include petroleum, mineral, animal, and insect waxes. The preferred waxes have melting temperatures of at least 30° C. and are readily compatible with the formed emulsion. A preferred wax has a melting temperature in a range of from about 40° C. to 75° C.

Typically, the continuous phase (including wax(es), if present) comprises from 1 to 10%, and preferably from 2 to 8% by weight of the total explosive composition, but higher proportions, for example in a range of from 1 up to 15 or even 20% may be tolerated.

If desired, additional components may be incorporated into the compositions of the present invention. For example, supplementary fuel components may be included. Typical supplementary fuel components suitable for incorporation into the discontinuous phase include soluble carbohydrate materials, such as glucose, sucrose, fructose, maltose and molasses, lower glycols, formamide, urea, methylamine nitrate, hexamethylene tetramine, hexamethylene tetramine nitrate, and other organic nitrates.

Supplementary fuel components which may be incorporated into the continuous phase include fatty acids, higher alcohols, vegetable oils, aliphatic and aromatic nitro organic compounds, such as dinitrotoluene, nitrate esters, and solid particulate materials such as coal, graphite, carbon sulphur, aluminium and magnesium.

Combinations of the hereinbefore described supplementary fuel components may be employed, if desired.

The amount of supplementary fuel components employed may be varied in accordance with the required characteristics of the compositions, but, in general, will be in a range of from 0 to 30, preferably from 5 to 25, % by weight of the total emulsion explosive composition.

Thickening and or cross-linking agents may be included in the compositions, if desired, generally in small amounts for example in the range 0.1% to 10%, and preferably from 1 to 5% by weight of the total explosive composition. Typical thickening agents include natural gums, such as guar gum or derivatives thereof, and synthetic polymers particularly those derived from acrylamide.

Minor amounts of non-volatile, water insoluble polymeric or elastomeric materials, such as natural rubber, synthetic rubber and polyisobutylene may be incorporated into the continuous phase. Suitable polymeric additives include butadiene-styrene, isopreneisobutylene, or isobutylene-ethylene copolymers. Terpolymers thereof may also be employed to modify the continuous phase, and in particular to improve the retention of occluded gases in the compositions.

Preferably, the emulsion explosive compositions of the present invention comprise a discontinuous gaseous component to reduce their density (to less than 1.5, and preferably to from about 0.8 to about 1.4 gm/cc) and enhance their sensitivity. The gaseous component, typically nitrogen, may be incorporated into the composition of the present invention as fine gas bubbles dispersed throughout the composition, hollow particles which are often referred to as microballoons or microspheres, porous particles, or mixtures thereof. A discontinuous phase of fine gas bubbles may be incorporated into the compositions of the present invention by mechanical agitation, injection or bubbling the gas through the composition, or by chemical generation of the gas in situ. Suitable chemicals for the in situ generation of gas bubbles include peroxides, such as hydrogen, peroxide, nitrites, such as sodium nitrite, nitrosoamines, such as N,N'-dinitrosopentamethylenetetramine, alkali metal borohydrides, such as sodium borohydride, and carbonates, such as sodium carbonate. Preferred chemicals for the in situ generation of gas bubbles are nitrous acid and its salts which decompose under conditions of acid pH to produce gas bubbles. Catalytic agents such as thiocyanate or thiourea may be used to accelerate the decomposition of a nitrite gassing agent. Suitable hollow particles include small hollow microspheres of glass and resinous materials, such as phenol-formaldehyde and urea-formaldehyde. Suitable porous materials include expanded minerals, such as perlite.

The gas component is usually added during cooling such that the prepared emulsion comprises from about 0.05 to 50% by volume of gas at ambient temperature and pressure. Conveniently the occluded gas is of bubble diameter below 200 μm, preferably below 100 μm, more preferably between 20 and 90 μm and particularly between 40 and 70 μm, in proportions less than 50%, preferably between 40 and 3%, and particularly preferably between 30 and 10% by volume. Preferably at least 50% of the occluded gas will be in the form of bubbles or microspheres of 20 to 90 μm, preferably 40 to 70 μm internal diameter.

An emulsion explosive composition according to the present invention may be prepared by conventional emulsification techniques. Thus, the oxygen-supplying component may be dissolved in the aqueous phase at a temperature above the crystallisation point of the salt solution, preferably at a temperature in the range of from 25° to 110° C., and a mixture, preferably a solution of modifier(s) and optional emulsifier(s), and organic phase is separately prepared, preferably at the same temperature as the salt solution. The aqueous phase is then added to the organic phase with rapid mixing to produce the emulsion explosive composition, mixing being continued until the formation is uniform. Optional solid and or gaseous components may then be introduced with further agitation until a homogeneous emulsion is obtained.

Hence the present invention further provides a process for the preparation of the hereinbefore described emulsion explosive composition which process comprises:

(a) dissolving the oxygen-supplying component in an aqueous composition at a temperature above the crystallization point of the oxygen-supplying component.
(b) combining said aqueous solution with the said organic-fuel medium and said modifier.
(c) mixing until the emulsion is uniform; and
(d) optionally mixing into the emulsion any solid ingredients and/or gaseous components.

As hereinbefore described it is preferred that the aqueous composition incorporates a buffer to provide an emulsion explosive pH, as herein defined of between 4.5 and 8.

Wherein the modifier comprises a hydrophilic moiety comprising a group capable of hydrolyzing to a carboxylic acid it will be preferred that the said group is hydrolyzed to a carboxylic acid on combining the aqueous solution and the organic-fuel medium.

An emulsion explosive composition according to the invention may be used as such, or may be packaged into charges of appropriate dimensions.

The invention is now illustrated by but not limited to the following examples in which all parts and percentages are expressed on a weight basis unless otherwise specified.

EXAMPLE 1

A mixture of chemically pure ammonium nitrate (75.6 parts), thoiurea (0.2 part), acetic acid (0.1 part), sodium acetate (0.1 part), ethanolamine (0.04 part) and water (19.0 parts) were heated with stirring to a temperature of about 85° C. to give an aqueous solution. Sodium hydroxide solution was added to give a pH* of 6.0. The hot aqueous solution was then poured, with rapid stirring, into a solution of 0.79 parts of "Lubrizol" 5986 ("Lubrizol" is a Registered Trade mark; "Lubrizol" 5986 is a commercially available poly(isobutene) succinic anhydride of average molecular weight in the range 800-1200 in a base oil) in distillate (4.17 parts). Stirring was continued until a uniform emulsion was obtained.

* pH was measured using a Radiometer PHM82 standard pH meter.

The viscosity at 60° C. as measured with Brookfield equipment at 50 rpm with a No 6 RV type spindle was 11,700 m P a.s. The emulsion conductivity was 4030 $pS.m^{-1}$. The stability of the emulsion as measured by crystallization of emulsion droplets after storage overnight at about 5° C. was excellent.

EXAMPLE 2

The procedure of Example 1 was repeated except that "Nitropril" ammonium nitrate (a commercially available ammonium nitrate made by the "Topan" process) was used, the acetic acid and ethanolamine were deleted from the composition, the sodium acetate was increased to 0.5 parts, and the "Lubrizol" 5986 was increased to 0.83 part.

The pH of the aqueous solution was again 6.0. The measured viscosity and emulsion conductivity were 13500 m P a.s and 3521 $\rho S.m^{-1}$ respectively. The emulsion stability was excellent.

EXAMPLE 3

(a) An explosive composition was prepared by the general procedure of Example 1 and having the following composition:

| | |
|---|---|
| "Nitropril" ammonium nitrate | 75.20 parts |
| water | 18.80 parts |
| sodium acetate | 1.00 parts |
| distillate | 4.00 parts |
| "Lubrizol" 5986 | 1.00 parts |

and the pH of the aqueous solution wa adjusted by addition of sodium hydroxide solution to 5.0.

The measured viscosity was 12500 mPa.s the emulsion conductivity was 3870 $\rho S.m^{-1}$, and the emulsion stability was excellent.

(b) An emulsion composition was prepared according to (a) above and after two weeks storage at room temperature the emulsion remained with an excellent consistency and there was no appreciable sign of crystallization.

EXAMPLES 4 to 7

Explosive composition were prepared by the general procedure of Example 1 and having the following composition:

| | |
|---|---|
| ammonium nitrate (chemically pure) | 75.64 parts |
| water | 19.01 parts |
| thiourea | 0.19 parts |
| sodium acetate | 0.16 parts |
| distillate | 4.00 parts |
| "Lubrizol" 5986 | 1.00 parts |

The pH's of the aqueous solutions were adjusted by the addition of either nitric acid solution or sodium hydroxide solution as required to give the appropriate pH as indicated in Table 1.

TABLE 1

| | Example | | | |
|---|---|---|---|---|
| | 4 | 5 | 6 | 7 |
| pH of aqueous solution | 4.5 | 5.0 | 6.0 | 7.0 |
| viscosity, m P a.s | 14100 | 12180 | 12200 | 15600 |
| emulsion conductivity, $\rho$ s.m$^{-1}$ | 5050 | 3370 | 2840 | 3990 |

The emulsion stabilities of these examples as measured by crystallization of emulsion droplets after storage overnight at about 1° C. were excellent.

EXAMPLE 8

An explosive composition was prepared according to the procedure of Example 1 with the following composition:

| | |
|---|---|
| ammonium nitrate (chemically pure) | 75.64 parts |
| water | 10.01 parts |
| thiourea | 0.19 parts |
| sodium acetate | 0.16 parts |
| distillate | 4.00 parts |
| Humphrey Chemical Company poly(isobutene) succinic anhydride | 1.00 parts |

The pH of the aqueous solutions was set to 5.0 with the addition of nitric acid solution. The measured viscosity was 14000 mPa.s, the emulsion conductivity was 355ρS.m$^{-1}$ and the emulsion stability was excellent.

EXAMPLE 9

An explosive composition was prepared according to the procedure of Example 8 except that the Humphrey Chemical Company poly(isobutene) succinic anhydride was replaced by that supplied commercially by Mobil Chemical Company as MCP 239. The measured viscosity was 13980 mPa.s, the emulsion conductivity was 284 ρS.m$^{-1}$, and the emulsion stability was excellent.

EXAMPLE 10

An explosive composition was prepared according to the procedure of example 1 with the following composition:

| | |
|---|---|
| ammonium nitrate (chemically pure) | 75.79 parts |
| water | 19.05 parts |
| thiourea | 0.19 parts |
| sodium acetate | 0.16 parts |
| distillate | 4.01 parts |
| "Lubrizol" 5986 | 0.80 parts |

The pH of the aqueous solution was set to 7.0 by the addition of sodium hydroxide solution. The measured viscosity was 14240 mPa.s, the emulsion conductivity was 3170 ρS.m$^{-1}$, and the emulsion stability was excellent.

EXAMPLE 11

An explosive composition was prepared according to the procedure of Example 1 with the following composition:

| | |
|---|---|
| ammonium nitrate (chemically pure) | 75.49 parts |
| water | 18.97 parts |
| thiourea | 0.19 parts |
| sodium acetate | 0.16 parts |
| distillate | 3.99 parts |
| "Lubrizol" 5986 | 1.20 parts |

The measured viscosity was 14280 mPa.s, the emulsion conductivity was 1836 ρS.m$^{-1}$, and the emulsion stability was excellent.

EXAMPLE 12

An explosive composition prepared according to the procedure of Example 1 with the following composition:

| | |
|---|---|
| ammonium nitrate (chemically pure) | 75.26 parts |
| water | 19.94 parts |
| thiourea | 0.19 parts |
| sodium acetate | 0.52 parts |
| distillate | 3.99 parts |
| "Lubrizol" 5986 | 1.00 parts |

The measured viscosity was 15300 mPa.s, the emulsion conductivity was 3438 ρS.m$^{-1}$, and the emulsion stability was good.

EXAMPLE 13

An explosive composition was prepared according to the procedure of Example 1 with the following composition:

| | |
|---|---|
| ammonium nitrate (chemically pure) | 75.54 parts |
| water | 18.99 parts |
| thiourea | 0.19 parts |
| disodium hydrogen orthophosphate | 0.28 parts |
| distillate | 4.00 parts |
| "Lubrizol" 5986 | 1.00 parts |

The measured viscosity was 13620 mPa.s, the emulsion conductivity was 3590 ρS.m$^{-1}$, and the emulsion stability was good.

EXAMPLE 14

An explosive composition was prepared according to the procedure of Example 1 with the following composition:

| | |
|---|---|
| ammonium nitrate (chemically pure) | 75.47 parts |
| water | 18.97 parts |
| thiourea | 0.19 parts |
| zinc nitrate | 0.38 parts |
| distillate | 3.99 parts |
| "Lubrizol" 5986 | 1.00 parts |

The measured viscosity was 15300 mPa.s, the emulsion conductivity was 2390 ρS.m$^{-1}$, and the emulsion stability was excellent.

EXAMPLE 15

An explosive composition was prepared as in Example 15 except that the pH of the aqueous solution was adjusted to 7.0 by the addition of sodium hydroxide solution.

The measured viscosity was 12040 mPa.s, the emulsion conductivity was 3941 ρS.m$^{-1}$, and the emulsion stability was excellent.

COMPARATIVE EXAMPLE 1

An explosive composition was prepared according to the procedure of Example 3 except that the pH of the aqueous solution was adjusted to 4.0 with nitric acid solution. The emulsion that initially formed on mixing the two phases was unstable and broke down as soon as the temperature fell to ambient.

COMPARATIVE EXAMPLE 2

An explosive composition was prepared as in Examples 4 to 7 except that the pH of the aqueous solution was set to 4.0 by the addition of nitric acid solution.

The measured viscosity was 12100 m ρa.s, the emulsion conductivity was 21550 ρS.m$^{-1}$, and the emulsion stability was poor.

EXAMPLE 16 AND COMPARATIVE EXAMPLE 3

The stability of an emulsion of the present invention was compared with a corresponding emulsion comprising a conventional emulsifier.

A composition of the invention (Example 16) comprising "Lubrizol" 5986 modifier and a composition comprising a prior Art emulsifier sorbitan mono-oleate (comparative Example 3) were prepared according to Example 1 using the following components (in parts by weight).

| | Example 16 (parts by weight) | Comparative Example 3 (parts by weight) |
|---|---|---|
| ammonium nitrate | 75.2 | 75.2 |
| water | 18.8 | 18.2 |
| sodium acetate | 1.0 | 1.0 |
| distillate | 4.0 | 4.0 |
| Modifier - "Lubrizol" 5986 | 1.0 | — |
| Emulsifier Sorbitan Mono-oleate | — | 1.0 |

The pH of the aqueous solution was adjusted to 6.0 by the addition of sodium by dioxide. The two compositions were stored at room temperature for two weeks and the degree of crystallisation in each was observed after each week using an optical microscope.

The composition of Example 16 was examined after one week and showed no sign of crystallization. Even after 2 weeks there was no appreciable crystallization in the sample.

The composition of Comparative Example 3 was examined after one week signs of appreciable crystallization were clearly visable even to the naked eye and after 2 weeks the composition was substantially crystallize.

EXAMPLE 17 and 17A

This example demonstrates the improvement in emulsion compositions of the present invention comprising the preferred modifiers over compositions prepared using other emulsifiers.

Compositions of the following components were prepared using the process of Example 1 except that the pH of the aqueous solution was adjusted to 6.3.

| | Example 17 (parts by weight) | Example 17A (parts by weight) |
|---|---|---|
| "Nitropril" ammonium nitrate | 75.2 | 75.2 |
| water | 18.8 | 18.8 |
| sodium acetate | 1.0 | 1.0 |
| distillate (fuel oil) | 3.5 | 3.5 |
| "Lubrizol" 5986 | 1.5 | — |
| oleic acid | — | 1.5 |

The compositions were stored at ambient temperature for three days.

After several hours the composition of Example 17A (comprising oleic acid) clearly showed the presence of crystal formations and after 3 days large crystal masses had formed.

In contrast the composition of Example 17 comprising "Lubrizol" 5986 showed no appreciable crystallization.

EXAMPLE 18

A composition of the following components was prepared according to Example 1 except that the pH of the aqueous solution was adjusted to 5.5.

| | (parts by weight) |
|---|---|
| "Nitropril" ammonium nitrate | 75.2 |
| water | 18.8 |
| sodium acetate | 1.0 |
| distillate | 3.5 |
| "Lubrizol" 5986 | 1.5 |

The viscosity at 60° C. was measured with Brookfield equipment at 50 rpm with No. 6 R V type spindle was in the range 13,000 to 15,000 m P.a.s.

The density of the composition was 1.38 kg/dm$^{-3}$.

Glass microballoons were added to the composition with mixing to give a final density of 1.18 kg/dm$^{-3}$. (The microballoons comprising approx. 3.8% by weight of the composition).

3.19 grams of the composition were placed into an 85 mm cartridge.

Detonation of the composition was carried out using "D" boosters and the velocity of detonation was measured and found to be 5.68 km/s.

EXAMPLE 19

This example demonstrates the preparation of a modifier in the form of a carboxylic acid salt (a mono basic salt of poly(isobutylene) succinic acid and the use thereof in the preparation of compositions of the invention.

"Lubrizol" 5988 composition (150 gram, equivalent to approximately 97.7 milli moles of head group) was heated to 40° and stirred while 4.3 gm of sodium hydroxide (107.1 milli moles), in 5 ml of water, was added.

The temperature rose to 64° C. and stirring was continued for 30 minutes before cooling to room temperature.

The composition was used in the preparation of an emulsion using the procedure of Example 1. The emulsion was found to be of good quality and stability.

We claim:

1. An emulsion explosive composition comprising a discontinuous oxidizer-phase containing an oxygen-supplying component and an organic-fuel medium forming a continuous phase wherein the oxygen-supplying component and organic-fuel medium are emulsified in the presence of a modifier comprising a hydrophilic moiety and a lipophilic moiety wherein the hydrophilic moiety comprises a carboxylic acid or a group capable of hydrolyzing to a carboxylic acid group, and wherein the lipophilic moiety is a saturated or unsaturated hydrocarbon chain, and wherein the said emulsion explosive composition pH, being the pH of the said oxidizer phase, is above 4.5.

2. An emulsion explosive composition according to claim 1 wherein the average molecular weight of the modifier is in the range 250 to 5000 inclusive.

3. An emulsion explosive composition according to claim 2 wherein the average molecular weight of the modifier is in the range 400 to 5000.

4. A composition according to claim 1 wherein in the modifier the lipophilic moiety is a saturated or unsaturated hydrocarbon chain derived from a polymer of a mono-olefin said polymer containing from 20 to 500 carbon atoms.

5. A composition according to claim 4 wherein the said mono-olefin contains from 2 to 6 carbon atoms.

6. A composition according claim 1 wherein the modifier is selected from poly[alkenyl]succinic acid and poly[alkenyl]succinic anhydride.

7. A composition according to claim 1 wherein the modifier is derived from interesterification of one or more saturated or unsaturated $C_{10}$ to $C_{20}$ mono hydroxy carboxylic acids.

8. A composition according to claim 6 wherein the modifier is a poly(isobutylene)succinic anhydride or a poly(isobutylene)succinic acid.

9. A composition according to claim 1 wherein the emulsion explosive pH is between 4.5 and 8.

10. A composition according to claim 1 wherein the amount of modifier is in the range from 0.1 to 5% by weight if the total composition.

11. A composition according to claim 1 wherein the oxygen-supplying component is selected from the group consisting of the alkali metal, alkaline earth metal and ammonium, nitrates, chlorales and perchlorates and mixtures thereof.

12. An emulsion explosive composition according to claim 11 wherein the oxygen-supplying component is selected from the group consisting of ammonium nitrate, sodium nitrate, calcium nitrate and mixtures thereof.

13. A composition according to claim 1 wherein the oxygen-supplying component comprises from 60 to 90% by weight of the total composition.

14. A composition according to claim 1 wherein the organic-fuel medium is selected from the group consisting of mineral oil diesel oil, paraffin oil, petroleum distillates, benzene, toluene, dinitrotoluene, styrene, xylenes and mixtures thereof.

15. A composition according to claim 14 wherein the organic fuel medium additionally comprises a wax.

16. A composition according to claim 1 wherein the water content of the total composition is in the range 2 to 30% by weight.

17. A composition according to claim 1 comprising a discontinuous gaseous component.

18. A composition according to claim 17 wherein the discontinuous gaseous component is selected from the group consisting of fine gas bubbles, hollow particles or microballoons, porous particles or mixtures thereof.

19. A composition according to claim 17 wherein the density of the discontinuous gaseous component is used to give a composition having a density in the range 0.8 to 1.4 g/cc.

20. A process for the preparation of an emulsion explosive composition of claim 1 which process comprises (a) dissolving the oxygen-supplying component in an aqueous composition at a temperature above the crystallisation point of the oxygen-supplying component, (b) combining said aqueous solution with said organic-fuel medium and said modifier;

(c) mixing until the emulsion is uniform; and (d) optionally mixing into the emulsion any solid ingredients and/or gaseous components and wherein the emulsion explosive pH, as herein defined, is between 4.5 and 8.

21. A process according to claim 20 wherein the said aqueous composition is prepared using a buffer to provide an emulsion explosive pH between 4.5 and 8.

22. A process according to claim 20 wherein the modifier comprises a hydrophilic moiety comprising a group capable of hydrolyzing to a carboxylic acid said process additionally comprising the step of hydrolyzing the said hydrophilic moiety.

23. The composition according to claim 1 wherein the lipophilic moiety of the modifier is a saturated or unsaturated hydrocarbon chain containing at least 20 carbon atoms.

* * * * *